United States Patent [19]

Nau et al.

[11] 4,168,288

[45] Sep. 18, 1979

[54] COMBINED CARBURETOR AND IMPULSE FUEL PUMP

[75] Inventors: Paul R. Nau, Wauwatosa; Heinz K. Gund, Brookfield, both of Wis.

[73] Assignee: Briggs & Stratton Corporation, Wauwatosa, Wis.

[21] Appl. No.: 920,231

[22] Filed: Jun. 29, 1978

[51] Int. Cl.[2] ..... F02M 37/12

[52] U.S. Cl. ..... 261/35; 417/395; 417/479

[58] Field of Search ..... 261/35; 417/395, 479

[56] References Cited

U.S. PATENT DOCUMENTS

| | | | |
|---|---|---|---|
| 2,713,854 | 7/1955 | Conover | 261/35 |
| 2,796,838 | 6/1957 | Phillips | 417/395 |
| 3,424,091 | 1/1969 | Turner | 417/395 |
| 3,556,687 | 1/1971 | O'Connor | 417/395 |
| 3,738,623 | 6/1973 | Tuckey | 261/35 |
| 3,743,254 | 7/1973 | Tuckey | 261/35 |

FOREIGN PATENT DOCUMENTS

| | | | |
|---|---|---|---|
| 226629 | 1/1959 | Australia | 261/35 |

*Primary Examiner*—Tim R. Miles

*Attorney, Agent, or Firm*—Ira Milton Jones

[57] ABSTRACT

A combined float bowl carburetor and fuel pump for small engines has a lateral extension on its carburetor body that terminates at a flat exterior surface to which open certain cavities and a passageway leading to the float valve inlet. A block-like pump body having flat inner and outer surfaces overlies said exterior surface and has cavities opening to its inner surface that cooperate with those in the carburetor body. A resilient pump membrane, providing a pump diaphragm and valves, is confined between the pump body and said exterior surface. Two cavities open to the outer face of the pump body, which is overlain by an imperforate resilient membrane to define inlet and outlet surge chambers that are respectively communicated with the pump by way of the inlet and outlet valves. All cavities, inlets and outlets are arranged to ensure maintenance of a consistent head of fuel at every inlet.

10 Claims, 7 Drawing Figures

Fig. 3
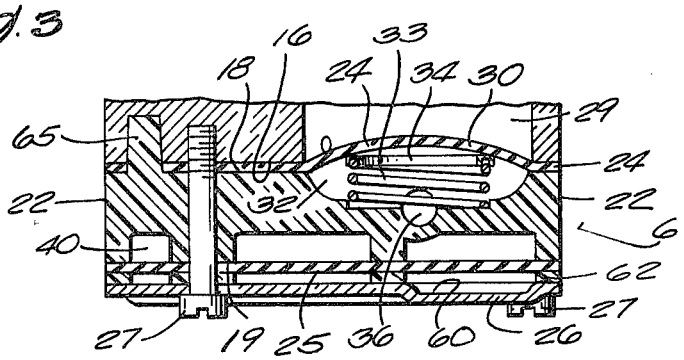
Fig. 4
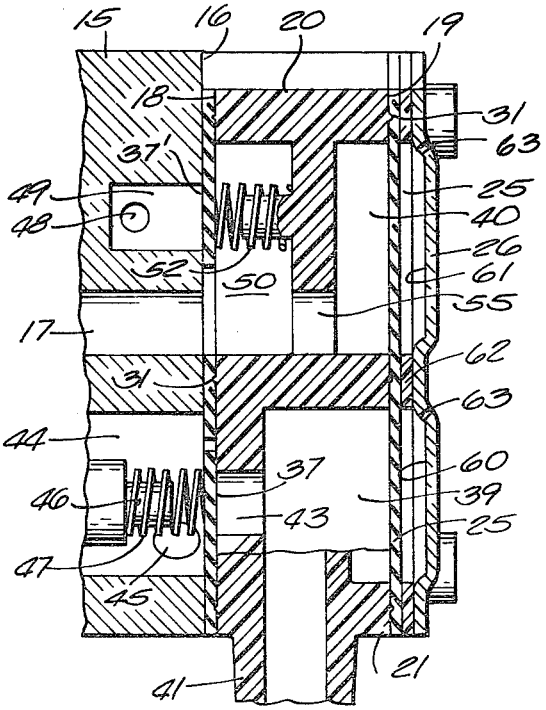
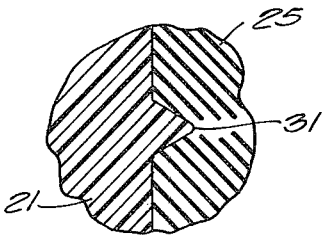
Fig. 5

COMBINED CARBURETOR AND IMPULSE FUEL PUMP

This invention relates to internal combustion engine fuel systems that comprise a fuel pump for transferring liquid fuel from a fuel tank to a carburetor float bowl; and the invention is more particularly concerned with a combined carburetor and fuel pump for such a fuel system, wherein the carburetor body constitutes a portion of the fuel pump and wherein the fuel pump is actuated by pressure pulsations imposed upon one side of a pump diaphragm from a source of pulsating pressure such as the interior of the engine crankcase.

In fuel systems of the type with which the present invention is concerned, a supply of fuel is maintained in a float bowl that is more or less integral with the carburetor body, and venturi suction in the carburetor mixing passage draws fuel up out of the float bowl and into the mixing passage through a jet nozzle. To ensure that the flow of fuel through the jet will change only in accordance with changes in venturi suction, fuel in the float bowl is kept at a constant level by means of a float actuated valve that controls the admission of fuel to the bowl.

The pump by which fuel is transferred from the fuel tank to the float bowl inlet must be capable of drawing fuel out of the tank at a rate sufficient to satisfy the maximum fuel flow requirement of the engine even when the tank is nearly empty. Hence such a pump must have a capacity which is substantially excessive for the condition in which the tank is nearly full and the engine requires a low rate of fuel flow. Nevertheless, the excess capacity of the pump cannot be allowed to bring about a condition of excess pressure at the float bowl inlet whereby the float controlled valve will be forced off its seat or prevented from closing. Furthermore, even during suction strokes of the pump, fuel should be present at the float bowl inlet and should be under a small head of pressure that will move it into the float bowl if the float valve is open.

U.S. Pat. No. 3,556,687, to A. J. O'Connor, discloses a fuel pump for small engines which is operated by crankcase pressure impulses from the engine that it serves. The pump of that patent has so-called booster chambers—actually surge cushioning chambers—whereby the pressure and suction impulses of the pump are smoothed to produce a fairly steady pressure on fuel at the float bowl inlet, rather than a pulsating one. Each of the so-called booster chambers has one wall that is defined by a flatwise flexible resilient membrane so that the volume of the chamber can expand with increasing fuel pressure and contract with decreasing fuel pressure. The pumped fuel passes through one such chamber immediately before entering the pump itself and another such chamber immediately after leaving the pump.

The mechanism of the O'Connor patent is described in that patent as "a pump and booster unit formed in a housing independent of a carburetor and engine." It will be apparent that there are advantages to be gained by integrating the fuel pump mechanism with the carburetor body; and in fact Marvel-Schebler Division of Borg-Warner Corporation has manufactured and sold such a combined float bowl carburetor and fuel pump.

The general object of the present invention is to provide a device of the type that comprises a float bowl carburetor combined with a fuel pump, wherein there are improvements that cause fuel in the float bowl to be very steadily and consistently maintained at a constant level notwithstanding widely varying conditions of engine operation and through the full range of levels of fuel in the tank.

More specifically, it is an object of this invention to provide a combined fuel pump and float bowl carburetor comprising a fuel pump of the diaphragm type, actuated by pressure pulsations, wherein a head of fuel tends to be maintained at the pump inlet at all times, to prevent the pump from losing its prime, and wherein a small head of fuel is also steadily maintained at the float bowl inlet, so that fuel can always flow into the float bowl whenever the float valve is open, even during suction strokes of the pump, to provide for very reliable maintenance of the desired level of fuel in the float bowl.

Any reciprocating engine tends to produce a certain amount of vibration when it is in operation, but in the case of a small engine installed on a riding tractor or similar machine, engine vibration is compounded with other possibly severe vibrations, as from the operation of an implement hitched to the machine and from bumps in terrain over which the machine moves. All such vibration tends to cause somewhat erratic opening and closing of the float valve as fuel sloshes in the float bowl and the float actuator bobs and joggles. If a relatively constant head of fuel is maintained at the float valve seat, the various erratic movements of the float valve have a cancelling effect upon one another, so that a satisfactorily uniform level of fuel is maintained in the foat bowl; but if pressure at the float bowl inlet is permitted to pulse in step with pulsations of the fuel pump, the float bowl fuel level tends to vary markedly so that the engine receives too rich a mixture at some times and too lean a mixture at other times. It is likewise desirable that there be a constant, steady flow of fuel from the fuel tank towards the fuel pump, rather than an intermittent flow that surges in step with pump pulsations, since pulsing motion requires repeated acceleration and deceleration of the stream of fuel moving towards the pump, and vibration can aggravate the unsteadiness of such fuel flow to the point where the pump is starved from time to time, further contributing to variations in float bowl fuel level. With these considerations in mind, it is another object of this invention to provide a combined carburetor and fuel pump of the character described which is so arranged that an even, steady pressure in the direction of flow tends to be maintained on fuel flowing both to and from the pump, notwithstanding that the pump is actuated by rather abrupt pressure pulsations.

Another object of the present invention is to provide a combined carburetor and fuel pump of the character described wherein the fuel pump component incorporates surge cushioning chambers and comprises relatively few and simple parts that cooperate with the carburetor body and can be readily assembled to it.

A further object of this invention is to provide a combined carburetor and fuel pump whereby all of the above stated objectives are obtained and wherein the carburetor body provides portions of the chambers and passageways of the pump mechanism, which chamber and passageway portions can be formed in the carburetor body without the need for difficult or unusual manufacturing operations.

Still another object of the invention is to provide a combined carburetor and diaphragm-type fuel pump of the above described character whereby all of the above stated objects are achieved and wherein the fuel pump component comprises a very compact subassembly that is mounted on the exterior of the carburetor body and consists, in the main, of a unitary body part that can be readily molded in plastic, a simple cover member that can be inexpensively made as a metal stamping, and a pair of resilient flat membranes that overlie opposite flat surfaces of the body part.

With these observations and objectives in mind, the manner in which the invention achieves its purpose will be appreciated from the following description and the accompanying drawing, which exemplify the invention, it being understood that changes may be made in the specific apparatus disclosed herein without departing from the essentials of the invention set forth in the appended claims.

The accompanying drawings illustrate one complete example of an embodiment of the invention constructed according to the best mode so far devised for the practical application of the principles thereof, and in which:

FIG. 3 is a sectional view taken on the plane of the line 3—3 in FIG. 1;

FIG. 4 is a fragmentary sectional view taken on the planes of the line 4—4 in FIG. 1, but on a larger scale than FIG. 1;

FIG. 5 is a greatly enlarged detail sectional view showing how a bead on one of the flat surfaces of the pump body cooperates with its adjacent resilient membrane to provide a seal;

Figure 1:
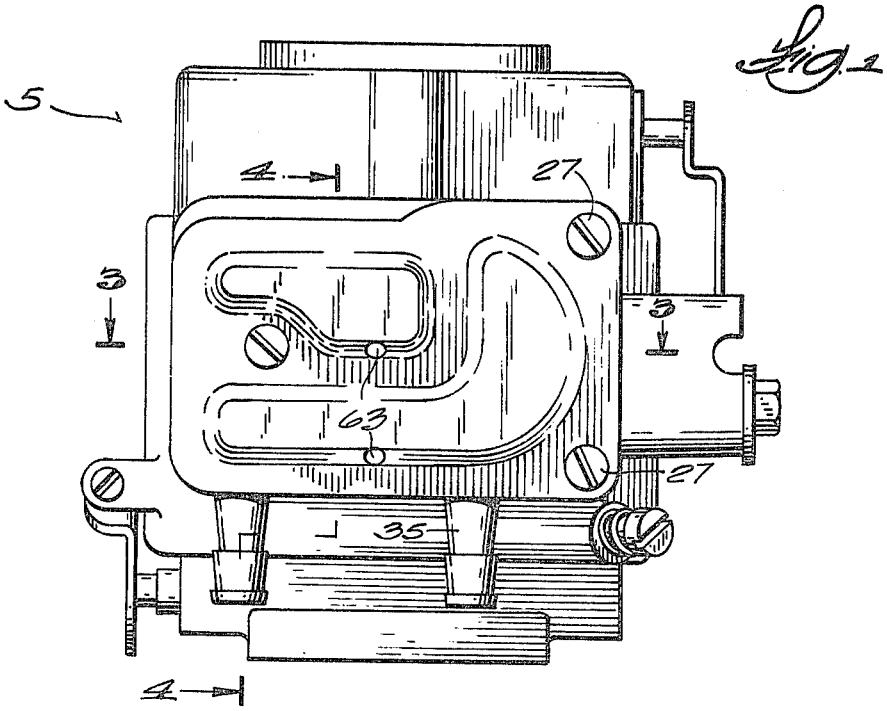
FIG. 1 is a view in elevation of a combined carburetor and fuel pump embodying the principles of this invention, as seen from the fuel pump side of the device.
Figure 2:
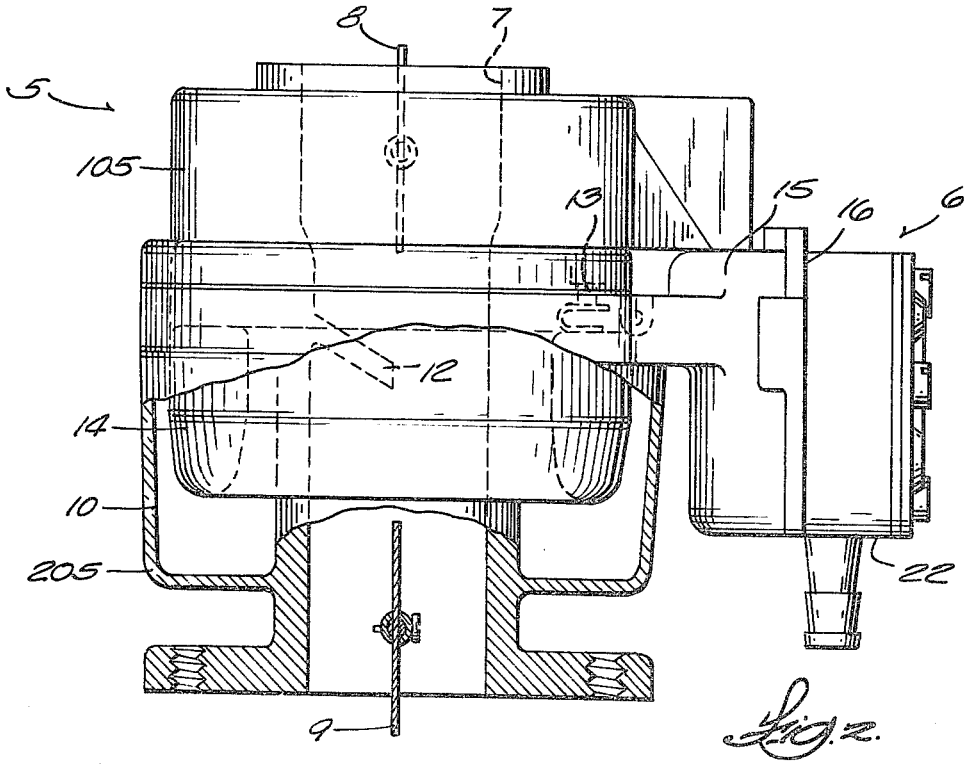
FIG. 2 is a view partly in elevation, taken from the left-hand side of FIG. 1, and partly in vertical section.
Figures 6, 7:
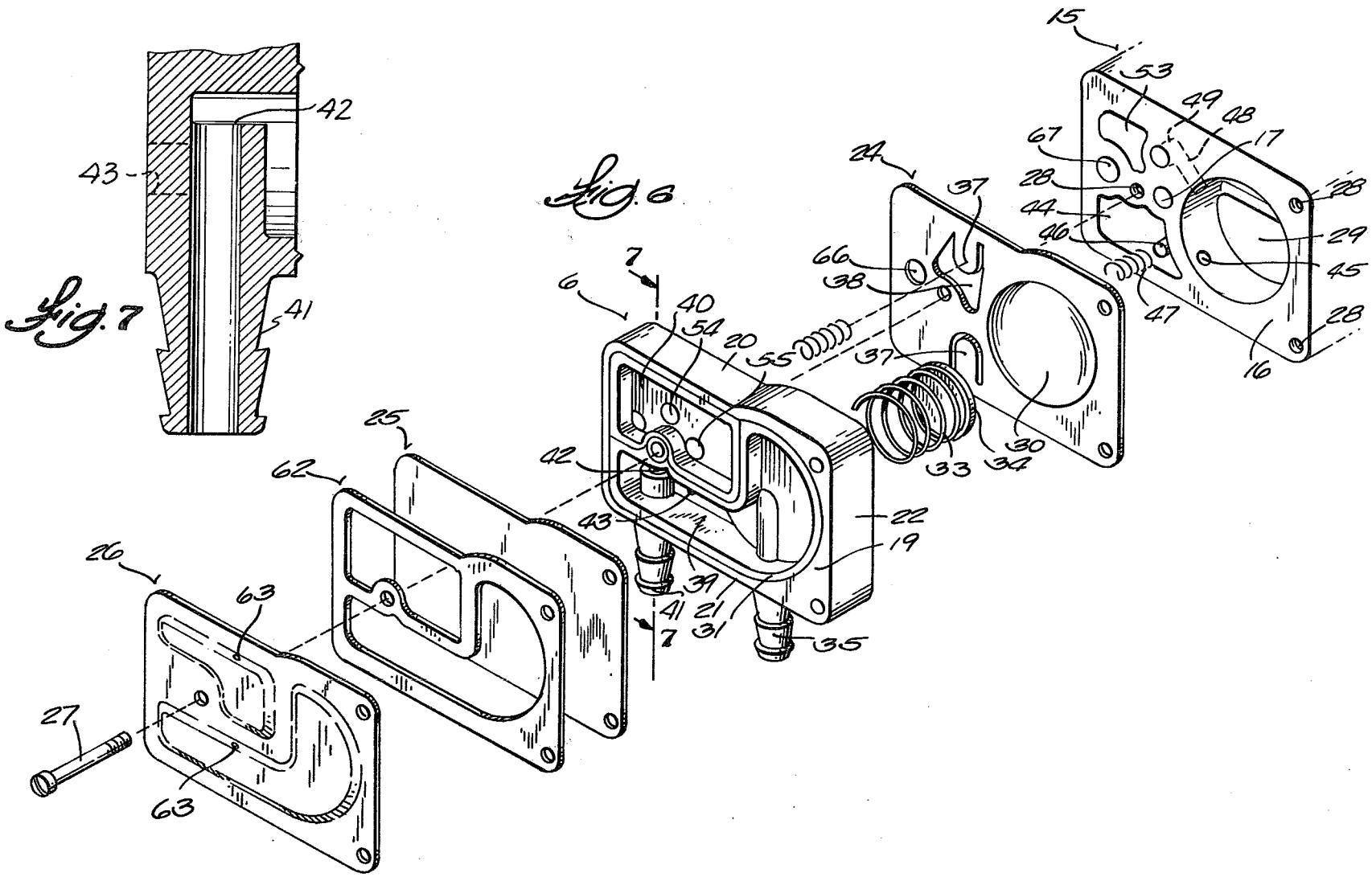
FIG. 6 is an exploded perspective view of the several components of the fuel pump in their relation to that portion of the carburetor body that combrises the fuel pump.
FIG. 7 is a sectional view through FIG. 6 on the plane on the line 7—7.

Referring now to the accompanying drawings, the numeral 5 designates generally the body of the carburetor component of a combined carburetor and fuel pump embodying the principles of this invention. The fuel pump component comprises a fuel pump body 6 which is mounted on one side of the carburetor body 5.

The particular carburetor body 5 that is here illustrated is more or less annular to define a vertical mixing passage 7 that has its inlet at the top of the carburetor. As the description proceeds, it will be apparent that the principles of this invention are equally applicable to other carburetor arrangements than the downdraft carburetor here specifically illustrated; and in fact the invention has also been successfully embodied in a carburetor having a horizontally extending mixing passage, with its float bowl located wholly beneath that mixing passage. The illustrated carburetor body is formed at its top for connection with a conventional air cleaner (not shown) and has its bottom formed for connection to a conventional engine intake manifold duct (not shown). A choke butterfly 8 is located near the upper inlet end of the mixing passage 7, and a throttle butterfly 9 is swingable in a lower portion of that passage.

In this case the lower portion of the carburetor body comprises an annular float bowl 10 that surrounds the mixing passage and normally contains a supply of fuel that is maintained at a constant level. Entry of fuel into the float bowl is controlled by means of a valve 13 that is actuated by a float 14 in the float bowl.

The carburetor body includes means defining at least one jet passage (not shown) that leads from the float bowl 10, at a level below the normal level of fuel therein, to a nozzle outlet 12 in a venturi portion of the mixing passage 7. In this case the carburetor body 5 comprises an upper body part 105 and a complementary lower body part 205, the latter defining the float bowl 10 and the upper body part having a portion of the jet passage therein.

The carburetor elements that have been mentioned to this point will be recognized as generally conventional in float bowl carburetors and therefore need not be described in further detail.

The fuel pump body 6 is mounted on a portion 15 of the carburetor body that projects to one side thereof and can be cast or molded in one piece with the lower part 205 of the carburetor body. The extension portion 15 terminates at a flat vertical surface 16 which is parallel to, and faces radially outwardly from, the vertical float bowl axis and is overlain by the pump body 6. Certain cavities in the carburetor body that are described below open to the vertical exterior surface 16, and from that surface a passageway 17 in the carburetor body leads inward to the float bowl inlet, which comprises the seat for the float valve 13.

The pump body 6 can comprise a block-like part that can be molded of plastic. It has an inner flat surface 18 that opposes the flat exterior surface 16 on the carburetor body and a flat outer surface 19 that is opposite and parallel to its inner surface 18. The inner and outer surfaces of the pump body are rectangular in outline and correspond in shape and size to the carburetor body exterior surface 16 that the pump body overlies. The pump body is relatively shallow, in that its opposite surfaces 18 and 19 are spaced apart by a relatively small distance, and therefore its top, bottom and side surfaces—respectively designated 20, 21, 22 and extending from one to the other of its flat surfaces 18 and 19—can be regarded as edge surfaces.

Confined between the flat inner surface 18 on the pump body and the exterior flat surface 16 on the carburetor body is a resilient pump membrane 24 which provides the diaphragm and valves of the fuel pump, as explained hereinafter. Overlying the outer flat surface 19 of the pump body is an imperforate resilient membrane 25 which cooperates with certain cavities in the pump body, as explained hereinafter, to provide expansible and contractable inlet and outlet surge cushioning chambers. A cover member 26 overlies the imperforate membrane 25 to flatwise clamp it in sealing relationship to the flat outer surface 19 of the pump body. The several members of the pump assembly are held in flatwise overlying relationship to one another and to the exterior flat surface 16 on the carburetor body by means of screws 27 that extend through registering holes in the cover member 26, the imperforate membrane 25, the pump body 6 and the pump membrane 24, and are received in threaded holes 28 in the carburetor body that open to its exterior surface 16. Each of the flat surfaces 18 and 19 on the pump body has a narrow raised bead 31 thereon that cooperates with the overlying resilient membrane 24, 25 to form a seal around the cavities which open to that flat surface.

Of the several cavities that open to the exterior flat surface 16 of the carburetor body, the largest, designated by 29, defines one of the pumping chambers of the fuel pump. The diaphragm 30 of the fuel pump, which comprises an imperforate area of the pump membrane 24, extends across the mouth of the cavity 29 to close it and to separate the pumping chamber that it defines from an opposite pumping chamber defined by a cavity 32 in the pump body that opens to its inner flat surface 18. In this case, the pumping chamber defined by the carburetor body cavity 29 is the liquid chamber, and the opposite pumping chamber, defined by the pump body cavity 32, is an actuating chamber which is subjected to pulsating pressure for actuation of the pump diaphragm 30. The two pumping chamber cavities 29 and 32 have circular mouths, both being of such diameter that the diaphragm 30 extends across a substantial portion of the height of the membrane 24. A coiled expansion spring 33 is confined in the pumping chamber cavity and reacts against the diaphragm 30 through a grommet-like reinforcing washer 34 to urge the diaphragm flatwise inwardly relative to the carburetor body.

For delivery of pulsing pressure to the actuating chamber, a nipple 35 projects from the bottom edge portion 21 of the pump body 6 and is communicated with the interior of the actuating chamber by way of a passage 36 in the pump body. The nipple 35 is connectable with a hose (not shown) or the like that is in turn communicated with the interior of the crankcase of the engine served by the fuel system, to subject the actuating chamber to the rapid alternations of suction and pressure that are developed in the crankcase by engine piston motion.

For control of fuel flow to and from the liquid chamber defined by the carburetor body cavity 29, the pump membrane 24 is formed with a pair of tongue-shaped flapper-type check valves 37 and 37' both of which are spaced to one side of the diaphragm portion 30 of that membrane. The check valve 37, which serves as an inlet valve for the pump, is defined by a narrow, slot-like, U-shaped cutout in the pump membrane and is located near the bottom edge thereof. The outlet check valve 37' is defined by a larger and somewhat irregularly shaped cutout 38 in the pump membrane and is near its top edge.

Attention is now directed to the outer side of the block-like pump body 6, which is overlain by the imperforate membrane 25. Two cavities 39 and 40 in the pump body open to its flat outer surface 19 and cooperate with the membrane 25 to define inlet and outlet surge chambers, repectively. The cavity 39 that defines the inlet surge chamber occupies the lower portion of the pump body but is L-shaped to have a portion which extends substantially to the top of that body. The outlet surge chamber cavity 40 is smaller and occupies an upper portion of the body 6.

For delivery of fuel from a tank (not shown) to the inlet surge chamber, the pump body has a second nipple 41 projecting from its bottom edge surface 21, which nipple is connectable to a hose or the like that leads from the fuel tank. Fuel enters the inlet surge chamber from the fuel line nipple 41 by way of an inlet 42 that is at a level some distance above the bottom of the cavity 39. The outlet 43 from the inlet surge chamber is at a lower level than the inlet 42. Hence, if any return flow of fuel to the tank tends to occur when the pump is not operating or is in an expulsion stroke, due to siphoning action or the like, fuel will nevertheless remain in the inlet surge chamber to a level high enough to cover the outlet 43, so that the pump will not lose its prime. Further assurance of positive pumping action is afforded by the L-shaped configuration of the cavity 39, whereby fuel which fills the inlet surge chamber to its top maintains a small head of pressure upon fuel at the outlet 43.

The outlet 43 from the inlet surge chamber is defined by a short bore that extends inwardly through the pump body and opens to its flat inner surface 18. When the inlet flapper valve 37 is closed, during the expulsion stroke of the pump, it overlies the inner end of the bore 43 to seal off the inlet surge chamber from the liquid chamber of the pump. In opening, the flapper valve 37 swings into a cavity 44 in the carburetor body that opens to its flat exterior surface 16. The carburetor body has a bored passage 45, located inwardly of its flat exterior surface 16, which extends from near the bottom of the cavity 44 to the cavity 29 that defines the liquid chamber of the pump itself. Because the cavity 44 is a relatively large one, it holds a sufficient supply of fuel to ensure that under all normal conditions fuel will be present at the inlet end of the passage 45 to be drawn into the liquid chamber of the pump.

A stud-like boss 46 is formed in the cavity 44, projecting partway out to the flat exterior surface 16 on the carburetor body, supports a light coiled expansion spring 47 which bears against the inlet flapper valve 37 to bias the same to its closed position.

It will be seen that the bore 43 in the pump body cooperates with the cavity 44 and the bore 45 in the carburetor body to provide a pump inlet passageway that leads from the inlet surge chamber past the inlet check valve 37 to the liquid chamber of the pump.

A passage that conducts fuel out of the liquid chamber has one portion 48 in the carburetor body that extends radially from the cavity 29, inwardly of the flat exterior surface 16, and has another portion 49 in the carburetor body that opens out to its surface 16. When the outlet flapper valve 37' is closed, it blocks the outlet of the last mentioned passage. When open, the flapper valve 37' is received in a cavity 50 in the pump body that opens to its inner flat surface 18 laterally adjacent to the pumping chamber cavity 32 and near the top of the pump body. A stud-like boss in the cavity 50, extending partway to the level of the inner surface 18 on the pump body, supports a coiled expansion spring 52 that bears against the flapper valve 37' to bias it to its closed position.

Through the cutout 38 in the pump membrane the cavity 50 in the pump body is communicated with the mouth of the delivery passage 17 that extends from the exterior flat surface 16 on the carburetor body to the float bowl inlet; and through that same cutout the cavity 50 is also communicated with a third cavity 53 in the carburetor body that opens to its flat exterior surface. Through a pair of bores 54 and 55 in the pump body the pump body cavity 50 is also communicated with the pump body cavity 40 that comprises the outlet surge chamber. Hence the cavity 50 in the pump body and the cavity 53 in the carburetor body are at all times communicated with one another and with the outlet surge chamber that comprises the cavity 40, and the cavities 50 and 53 thus serve as extensions or enlargements of the outlet surge chamber. Note that the bore 54 in the pump body is in line with the mouth of the pump outlet passage portion 49 in the carburetor body, and the bore 55 is in line with the inlet to the delivery passage 17, to facilitate flow of fuel directly to and from the outlet surge chamber.

The delivery passage 17, by which fuel is conducted from the cavity 50 in the pump body to the float bowl inlet, is defined by a horizontal bore extending into the carburetor body from its exterior surface 16, in cooperation with communicating bores (not shown) that are drilled into the carburetor body from other surfaces thereof.

The steadiness of the pressure in the flow direction that is exerted upon fuel flowing to and from the liquid chamber of the fuel pump has been found to depend not only upon the change in volume that can take place in the inlet and outlet surge chambers by virtue of resilient flatwise flexing of the imperforate membrane 25 but also upon the effective volume of those surge chambers. Over a rather broad range of values, it has been found that smoothness of fuel flow and reliability of fuel level maintenance in the float bowl increases with increasing volume of the surge chambers. It is for this reason that the cavity 53 that opens to the inner flat surface of the pump body is effectively made a part of the outlet surge chamber by means of the bores 54 and 55, and said surge chamber is further effectively enlarged by its communication, through the cutout 38 in the pump membrane 24, with the blind cavity 53 in the carburetor body. In the same way, the relatively large cavity 44 in the carburetor body that receives fuel just before it enters the liquid chamber of the pump cooperates with the inlet surge chamber (with which it is communicated by way of the inlet valve 37) to maintain a steady pressure on fuel that is on its way to the pump.

Another feature of the structure of the present invention that promotes reliably accurate maintenance of a constant level of fuel in the float bowl is the arrangement of the passages in the pump body and carburetor body in such a manner that the force of gravity maintains a head of fuel at the inlet to the pump and at the inlet to the float bowl. It has already been pointed out that in the inlet surge chamber defined by the cavity 39 in the pump body the outlet 43 is at a lower level than the inlet 42 to prevent back-siphoning of fuel towards the tank during the intake stroke of the pump, and that the inlet surge chamber is L-shaped to normally maintain fuel therein to a level substantially above its outlet. The short bored passage 45 in the carburetor body that communicates the cavity 44 in the carburetor body with the liquid chamber of the pump likewise has its inlet end at a low level in the cavity 44, and that cavity has a relatively large volume to ensure that fuel will always be present and under a pressure head at the inlet to the passage 45.

The passage 48, 49 that conducts fuel from the liquid chamber of the pump to the outlet flapper valve 37' has its outlet end at a relatively high level in the carburetor body, whereas the inlet portion of the delivery passageway 17 in the carburetor body opens to the flat exterior surface 16 at a level below the outlet flapper valve 37', again serving to maintain a head of pressure on fuel moving to the float valve inlet from the pump.

To provide for adequate expansion of the surge chambers comprising the outwardly opening cavities 39 and 40 in the pump body, the cover member 26 that overlies the imperforate membrane 25 is outwardly embossed to define shallow, inwardly opening recesses 60, 61 into which that membrane can flatwise flex. The cover member can suitably comprise a stamped metal plate. Preferably a gasket 62 is interposed between the imperforate membrane and the cover member, having a shape substantially identical with that of the flat outer surface 19 on the pump body, to cooperate with the recesses in the cover plate in providing room for outward flexing of the membrane. Small vent holes 63 in the cover plate provide for displacement of air at the outer side of the imperforate membrane so that its flatwise flexing will not be impeded by suction or pressure in the recesses 60 and 61.

To facilitate assembly of the several parts of the pump, the pump body is preferably formed with an integral locating pin 65 that projects from its inner flat surface 18. That pin extends through a hole 66 in the pump membrane 24 and is received in a well 67 in the carburetor body that opens to its flat surface 16.

From the foregoing description taken with the accompanying drawings it will be apparent that this invention provides a combination fuel pump and float bowl carburetor that is well suited for small engines in being compact, simple and inexpensive, and whereby fuel is subjected to a substantially steady and constant pressure by which it is moved from a fuel tank towards the float bowl inlet.

Those skilled in the art will appreciate that the invention can be embodied in forms other than as herein disclosed for purposes of illustration.

The invention is defined by the following claims.

We claim:

1. A combined carburetor and liquid fuel pump wherein the carburetor is of the type comprising a body that defines a mixing passage into which fuel is aspirated from a float bowl and the fuel pump is of the type comprising a resilient pump membrane that has portions which provide flatwise swingable flapper-type inlet and outlet check valves and another imperforate portion comprising a diaphragm that separates a pair of pumping chambers, one of said pumping chambers being an actuating chamber communicated with a source of pulsating pressure by which the diaphragm is flexed and the other of said pumping chambers being a liquid chamber into which fuel is drawn past the inlet check valve and from which it is expelled past the outlet check valve, said combined carburetor and liquid fuel pump being characterized by:

A. the carburetor body
  (1) having a flat, vertical exterior surface which is overlain by said pump membrane and
  (2) having a cavity which opens to said surface and defines one of said pumping chambers;

B. a pump body having opposite flat inner and outer surfaces, said pump body being secured to the carburetor body with its said surfaces vertical and its inner surface in flatwise opposing relation to said exterior surface on the carburetor body and cooperating therewith to sealingly clamp the pump membrane;

C. said pump body having a cavity that opens to its said inner surface and is opposite said cavity in the carburetor body to provide the other pumping chamber;

D. said pump body also having a pair of cavities opening to its said outer flat surface,
  (1) one of which has a portion near the bottom of the pump body and provides for an inlet surge chamber, and
  (2) the other of which has a portion near the top of the pump body and provides for an outlet surge chamber;

E. an imperforate flexible membrane overlying said outer flat surface of the pump body to cooperate with said pair of cavities in defining said surge chambers and which, by its flatwise flexing, provides for expansion and contraction of said surge chambers;

F. a cover member secured to the pump body and overlying the imperforate membrane to sealingly clamp the same against said outer surface on the pump body, said cover member having an inwardly opening recess opposite each of said surge chambers into which an underlying area of the imperforate membrane can flex for expansion of the surge chambers; and G. each of said bodies having passage portions which open to mouths at the flat surface on the body that opposes the flat surface on the other body, each passage portion in one body being communicated through the pump membrane with a complementary passage portion in the other body, said passage portions defining (1) an inlet passage that leads from said portion of said cavity that defines the inlet surge chamber, past the inlet check valve, to the liquid chamber, (2) an outlet passage that leads from the liquid chamber past the outlet check valve to said portion of said cavity that defines the outlet surge chamber, and (3) a delivery passage that leads from a bottom portion of said cavity that defines the outlet surge chamber to a float controlled inlet to the float bowl.

2. The combined carburetor and liquid fuel pump of claim 1 wherein said cavity in the carburetor body provides the liquid chamber of the fuel pump, further characterized by:

(1) the carburetor body having a second cavity opening to its exterior flat surface and communicated with the first cavity therein by a passage in the carburetor body that is wholly inward of said exterior flat surface, said second cavity comprising a portion of said inlet passage and accommodating flatwise opening movement of the inlet check valve; and (2) said pump body having a second cavity opening to its inner surface that accommodates flatwise opening movement of the outlet check valve, the last mentioned cavity (a) being communicated by means of a passage in the pump body with the outlet surge chamber and (b) being communicated through the pump membrane with the portion of the delivery passage that is in the carburetor body, so that said second cavity that opens to the inner surface of the pump body comprises a portion of both the outlet passage and of the delivery passage.

3. The combined carburetor and fuel pump of claim 2 wherein the pump body is shallow between said opposite flat surfaces thereon and has an edge surface extending therearound and from one to the other of said flat surfaces, further characterized by:

(1) a first nipple projecting from said edge surface on the pump body, for connection with a source of pulsating pressure, said first nipple being communicated by a passage in the pump body with the first mentioned cavity that opens to the inner flat surface on the pump body;

(2) a second nipple projecting from said edge surface on the pump body, for connection with a fuel source; and (3) the pump body having a passage which communicates said second nipple with the inlet surge chamber and opens into that chamber above the level at which the inlet passage leads therefrom.

4. The combined carburetor and liquid fuel pump of claim 1 wherein said cover member comprises a metal plate and wherein said inwardly opening recesses therein are provided by outwardly embossed portions thereof.

5. The combined carburetor and fuel pump of claim 2, further characterized by:

the carburetor body having a third cavity opening to its exterior flat surface which is communicated through an aperture in the pump membrane with said second cavity in the pump body and hence with the outlet surge chamber and with the delivery passage, said third cavity in the carburetor body thus serving to enlarge the effective volume of the outlet surge chamber.

6. A combined carburetor and diaphragm-type liquid fuel pump wherein the carburetor has a body that provides a float bowl and defines a mixing passage into which fuel is aspirated from the float bowl, said body having a flat exterior surface which is parallel to the axis of the float bowl and which is therefore vertical when the carburetor is in its operative position, and wherein the fuel pump comprises a pump body that has opposite flat inner and outer surfaces and is mounted on the carburetor body with its inner surface overlying said exterior surface of the carburetor body, and a flexible pump membrane confined between the two last mentioned surfaces and having an imperforate area which provides a pump diaphragm that separates a cavity in the carburetor body, opening to its said exterior surface and defining a liquid chamber, from a cavity in the pump body that opens to its said inner surface and defines a pressure chamber at which pulsing pressure is imposed upon the diaphragm to flex the same, said bodies cooperating to define fuel passages that are controlled by inlet and outlet valves integral with the pump membrane and through which fuel flows to the liquid chamber, and from the liquid chamber to the float bowl inlet, in consequence of flexing of the diaphragm, said combined carburetor and fuel pump being characterized by:

A. the pump body having a cavity opening to its said outer surface that provides a fuel inlet chamber;

B. cover means overlying said outer surface of the pump body to close said fuel inlet chamber;

C. said fuel inlet chamber having near its bottom an outlet from which fuel flows through one of said fuel passages and past the inlet valve to the liquid chamber;

D. said pump body having a nipple projecting from another surface portion thereof, said nipple being connectable with a source of fuel and being communicated with said fuel inlet chamber at a level therein that is above said outlet so that fuel cannot be drawn away from said outlet by siphoning of fuel from the fuel inlet chamber towards said source; and E. said pump body having a second nipple projecting from still another surface portion thereof, said second nipple being communicated with said pressure chamber and being connectable with a source of pulsating pressure for actuating the diaphragm.

7. The combined carburetor and fuel pump of claim 6, further characterized by:

F. said cover means comprising (1) an imperforate flexible membrane of a size and shape coextensive with said outer surface of the pump body, and (2) a substantially rigid plate of the same size and shape, secured to the pump body in overlying relation to said imperforate membrane and by which said imperforate membrane is sealingly confined against said outer surface of the pump body, said plate having an outwardly embossed portion overlying the fuel inlet chamber to provide for flatwise flexing of the imperforate membrane by which the volume of the fuel inlet chamber is expanded and contracted.

8. The combined carburetor and fuel pump of claim 7, further characterized by:

G. said pump body having a second cavity opening to its outer surface with which said imperforate membrane cooperates to provide an expansible and contractable outlet chamber, said outlet chamber being (1) communicated with the liquid chamber of the pump through a fuel passage controlled by said outlet valve and (2) communicated with the float bowl inlet through another fuel passage.

9. The combined carburetor and fuel pump of claim 8, further characterized by said other fuel passage by which said outlet chamber is communicated with the float bowl inlet being defined in part by a cavity in the pump body, opening to said exterior surface thereof, whereby the volume of said outlet chamber is effectively enlarged.

10. The combined carburetor and fuel pump of claim 8, further characterized by:

(1) the first mentioned cavity in the pump body that opens to said outer surface thereof being substantially L-shaped, with a horizontal leg in which said outlet is located and a vertical leg that extends to near the top of the pump body to provide a head of fuel at said outlet; and (2) said second cavity in the pump body that opens to its outer surface being located over the horizontal leg of said first cavity.

* * * * *